US008978639B2

(12) United States Patent
Halverson et al.

(10) Patent No.: US 8,978,639 B2
(45) Date of Patent: Mar. 17, 2015

(54) SECONDARY ROOM AIR HEAT EXCHANGER AND METHOD OF HEATING SECONDARY ROOM AIR

(75) Inventors: Joshua H. Halverson, Oronoco, MN (US); John G. Pecka, Chippewa Falls, WI (US); Bruno J. Miller, Lakeville, MN (US)

(73) Assignee: Hearth & Home Technologies, Inc., Lakeville, MN (US)

( * ) Notice: Subject to any disclaimer, the term of this patent is extended or adjusted under 35 U.S.C. 154(b) by 0 days.

(21) Appl. No.: 13/273,832

(22) Filed: Oct. 14, 2011

(65) Prior Publication Data

US 2013/0092150 A1 Apr. 18, 2013

(51) Int. Cl.

| | |
|---|---|
| ***F24B 1/188*** | (2006.01) |
| ***F24C 3/00*** | (2006.01) |
| ***F24C 15/00*** | (2006.01) |

(52) U.S. Cl.

CPC ..... *F24B 1/188* (2013.01); *F24C 3/002* (2013.01); *F24C 15/001* (2013.01)

USPC ..... 126/523; 126/525; 126/527; 126/515

(58) Field of Classification Search

USPC ..... 126/500, 515, 516, 521–525, 527; 165/164, 165, 154

See application file for complete search history.

(56) References Cited

U.S. PATENT DOCUMENTS

| | | | | |
|---|---|---|---|---|
| 324,106 | A | | 8/1885 | Hamilton |
| 1,383,506 | A | | 7/1921 | Westerlund |
| 2,186,539 | A | | 1/1940 | Slayter et al. |
| 2,231,258 | A | | 2/1941 | Elmore et al. |
| 2,484,292 | A | | 10/1949 | Hermanson |
| 2,671,440 | A | * | 3/1954 | Dupler ..... 126/512 |
| 2,882,023 | A | * | 4/1959 | Rizzo ..... 165/299 |
| 3,834,619 | A | | 9/1974 | Glover |
| 3,934,798 | A | * | 1/1976 | Goldsmith ..... 237/55 |
| 3,999,710 | A | | 12/1976 | Kemmerer |
| 4,043,313 | A | * | 8/1977 | Sherman ..... 126/502 |
| 4,044,950 | A | * | 8/1977 | Engeling et al. ..... 237/55 |
| 4,103,735 | A | | 8/1978 | Warner |
| 4,112,914 | A | | 9/1978 | Brown |
| 4,126,118 | A | | 11/1978 | Haynes |
| 4,129,114 | A | | 12/1978 | Hiser |
| 4,130,105 | A | | 12/1978 | Melton |
| 4,141,336 | A | * | 2/1979 | Fitch ..... 126/502 |
| 4,143,638 | A | | 3/1979 | Kamstra |
| 4,160,524 | A | | 7/1979 | Stiber |
| 4,192,286 | A | | 3/1980 | Wormington |

(Continued)

FOREIGN PATENT DOCUMENTS

| | | |
|---|---|---|
| CA | 2380552 A1 | 10/2002 |
| DE | 3211488 A1 | 10/1983 |

(Continued)

OTHER PUBLICATIONS

International Search Report and Written Opinion for PCT/US2008/086660, mailed Apr. 28, 2009, 12 pages.

*Primary Examiner* — Alfred Basichas
(74) *Attorney, Agent, or Firm* — Faegre Baker Daniels LLP

(57) ABSTRACT

Heating a room in a structure with a fireplace includes feeding combustible gas to a burner of a combustion assembly of the fireplace to create heat and flames with hot exhaust air passing out of a combustion chamber of the fireplace through an exhaust duct and into an exhaust air conduit of a secondary heat exchanger and out of the structure.

20 Claims, 4 Drawing Sheets

(56) References Cited

U.S. PATENT DOCUMENTS

| | | | | | |
|---|---|---|---|---|---|
| 4,206,743 | A | | 6/1980 | Niemela | |
| 4,206,744 | A | | 6/1980 | Mahoney et al. | |
| 4,224,544 | A | | 9/1980 | McKinnon et al. | |
| 4,230,268 | A | | 10/1980 | Gorman et al. | |
| 4,231,516 | A | | 11/1980 | Weingartner | |
| 4,243,177 | A | | 1/1981 | Powers | |
| 4,270,513 | A | | 6/1981 | Mitchelson | |
| 4,278,126 | A | | 7/1981 | Skrzypek | |
| 4,291,670 | A | * | 9/1981 | Hyatt | 126/512 |
| 4,297,990 | A | | 11/1981 | Allisbaugh | |
| 4,308,990 | A | * | 1/1982 | Borovina et al. | 236/10 |
| 4,312,320 | A | * | 1/1982 | Jennings | 126/79 |
| 4,319,557 | A | | 3/1982 | Sietmann et al. | |
| 4,353,350 | A | | 10/1982 | Albrecht | |
| 4,364,514 | A | | 12/1982 | Toporek | |
| 4,379,447 | A | | 4/1983 | Schott et al. | |
| 4,381,819 | A | * | 5/1983 | Paolino | 165/156 |
| 4,408,716 | A | * | 10/1983 | Rockwell | 237/55 |
| 4,426,994 | A | | 1/1984 | Burger et al. | |
| 4,438,756 | A | | 3/1984 | Chamberlain et al. | |
| 4,459,816 | A | | 7/1984 | Lung et al. | |
| 4,473,064 | A | | 9/1984 | Jacques | |
| 4,509,588 | A | | 4/1985 | Parham | |
| 4,515,145 | A | | 5/1985 | Tallman et al. | |
| 4,545,360 | A | | 10/1985 | Smith et al. | |
| 4,558,689 | A | * | 12/1985 | McCann | 126/117 |
| 4,582,044 | A | | 4/1986 | Ferguson et al. | |
| 4,735,130 | A | | 4/1988 | Seppamaki | |
| 4,738,241 | A | * | 4/1988 | Bernelov et al. | 126/522 |
| 4,754,806 | A | * | 7/1988 | Astle, Jr. | 165/6 |
| 4,773,589 | A | | 9/1988 | Boyd | |
| 4,793,322 | A | | 12/1988 | Shimek et al. | |
| 4,817,391 | A | | 4/1989 | Roe et al. | |
| 4,887,586 | A | * | 12/1989 | Walters | 126/101 |
| 4,928,667 | A | | 5/1990 | Shaw | |
| 4,987,748 | A | | 1/1991 | Meckler | |
| 5,009,219 | A | | 4/1991 | Liet | |
| 5,046,481 | A | * | 9/1991 | Warwick | 126/522 |
| 5,062,411 | A | * | 11/1991 | Karabin et al. | 126/523 |
| 5,092,313 | A | | 3/1992 | Blackburn et al. | |
| 5,123,360 | A | | 6/1992 | Burke et al. | |
| 5,127,878 | A | | 7/1992 | Meckler | |
| 5,218,953 | A | * | 6/1993 | Shimek et al. | 126/512 |
| 5,224,650 | A | | 7/1993 | Gozikowski | |
| 5,257,736 | A | | 11/1993 | Roy | |
| 5,267,552 | A | | 12/1993 | Squires et al. | |
| 5,303,693 | A | | 4/1994 | Schroeter et al. | |
| 5,385,299 | A | | 1/1995 | Zawada | |
| 5,392,763 | A | | 2/1995 | Shaw et al. | |
| 5,450,841 | A | | 9/1995 | Whitaker et al. | |
| 5,452,708 | A | | 9/1995 | Shimek et al. | |
| 5,460,162 | A | | 10/1995 | Binzer | |
| 5,460,511 | A | | 10/1995 | Grahn | |
| 5,497,761 | A | | 3/1996 | Mayr | |
| 5,499,622 | A | * | 3/1996 | Woods | 126/500 |
| 5,572,986 | A | | 11/1996 | Eberhardt | |
| 5,647,340 | A | * | 7/1997 | Shimek et al. | 126/85 B |
| 5,655,514 | A | | 8/1997 | Kowald et al. | |
| 5,669,374 | A | * | 9/1997 | Valters et al. | 126/512 |
| 5,673,683 | A | | 10/1997 | Beal et al. | |
| 5,727,540 | A | | 3/1998 | Eberhardt | |
| 5,873,356 | A | | 2/1999 | Vossler et al. | |
| 5,904,137 | A | | 5/1999 | Salley | |
| 5,944,090 | A | * | 8/1999 | Teal | 165/47 |
| 5,947,113 | A | | 9/1999 | Beal et al. | |
| 5,983,890 | A | * | 11/1999 | Thomas et al. | 126/512 |
| 6,019,099 | A | | 2/2000 | Shimek et al. | |
| 6,047,695 | A | | 4/2000 | Eberhardt | |
| 6,053,165 | A | | 4/2000 | Butler et al. | |
| 6,145,502 | A | | 11/2000 | Lyons et al. | |
| 6,209,622 | B1 | | 4/2001 | Lagace et al. | |
| 6,209,624 | B1 | | 4/2001 | Cameron | |
| 6,216,684 | B1 | | 4/2001 | Champion | |
| 6,543,698 | B1 | | 4/2003 | Lyons et al. | |
| 6,550,687 | B2 | | 4/2003 | Lyons et al. | |
| 6,729,551 | B2 | | 5/2004 | Lyons et al. | |
| 6,755,138 | B2 | | 6/2004 | McCarren | |
| 6,908,039 | B2 | * | 6/2005 | Lyons et al. | 237/55 |
| 7,575,178 | B2 | * | 8/2009 | Loewen et al. | 236/10 |
| 2005/0076903 | A1 | * | 4/2005 | Briere | 126/503 |
| 2006/0137678 | A1 | | 6/2006 | Tsunekawa et al. | |
| 2007/0044790 | A1 | * | 3/2007 | Carlo | 126/512 |
| 2008/0156892 | A1 | | 7/2008 | Eberhardt | |
| 2009/0151711 | A1 | | 6/2009 | Wells et al. | |
| 2010/0025487 | A1 | * | 2/2010 | Kaneiwa | 237/2 A |

FOREIGN PATENT DOCUMENTS

| | | | |
|---|---|---|---|
| DE | 3335008 | A1 | 4/1984 |
| GB | 140989 | A | 4/1920 |
| GB | 749073 | A | 6/1954 |
| GB | 1041223 | A | 3/1963 |
| GB | 2116299 | A | 9/1983 |
| GB | 2136107 | A | 9/1984 |
| JP | 5760118 | A | 4/1982 |
| JP | 62258935 | A | 11/1987 |

* cited by examiner

SECONDARY ROOM AIR HEAT EXCHANGER AND METHOD OF HEATING SECONDARY ROOM AIR

BACKGROUND

Gas, electric, and wood burning fireplaces provide warmth and/or the visual appeal of a fire within a room. Thermally efficient fireplaces save fuel cost and environmental impact. While various improvements in fireplace efficiency have been achieved, further improvements remain to be realized.

SUMMARY

Some aspects relate to a fireplace system including a fireplace and a secondary heat exchanger. The fireplace includes a housing, a combustion chamber, a combustion assembly, an exhaust duct, and a fresh air intake duct, The housing has a front, a back, a first side, and a. second side. The combustion chamber is disposed within the housing, the combustion chamber and the housing combining to define a primary heat exchanger about the combustion chamber, the primary heat exchanger having an inlet for receiving primary room air from a room in which the fireplace is installed and an outlet for delivering air that has passed through the primary heat exchanger back into the room in which the fireplace is installed. The combustion assembly includes a burner configured for burning combustible gas in the combustion chamber. The exhaust duct carries exhaust air generated by combustion of the combustible gas in the combustion chamber out of the combustion chamber and away from the fireplace. The fresh air intake duct for carries fresh air from outside of the fireplace to the combustion assembly. The secondary heat exchanger includes an exhaust air conduit, a secondary room air conduit, an intake air conduit, and a coupling duct. The exhaust air conduit receives the exhaust air from the exhaust duct of the fireplace. The secondary room air conduit receives secondary room air. The intake air conduit passes fresh intake air into the fresh air intake duct of the fireplace, the secondary heat exchanger being configured to transfer heat from the exhaust air passing through the exhaust air conduit into the secondary room air passing through the secondary room air conduit and the fresh intake air passing through the fresh intake air conduit. The coupling duct passes secondary room air from the secondary heat exchanger into the primary heat exchanger.

Other aspects relate to a method of heating a room in a structure with a fireplace. The method includes feeding combustible gas to a burner of a combustion assembly of the fireplace to create heat and flames with hot exhaust air passing out of a combustion chamber of the fireplace through an exhaust duct and into an exhaust air conduit of a secondary heat exchanger and out of the structure. Fresh intake air is passed from outside the structure into an intake air conduit of the secondary heat exchanger through an intake duct of the fireplace and to the combustion assembly. Primary room air is passed from the room in the structure through a primary heat exchanger in the fireplace to transfer heat from the combustion chamber to the primary room air. Secondary room is passed through the secondary heat exchanger and from the secondary heat exchanger into the primary heat exchanger, the secondary heat exchanger transferring heat from the exhaust air into the fresh intake air and the secondary room air.

While various aspects of embodiments are disclosed, stilt other embodiments of the present invention are disclosed and should be apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Various embodiments relate to fireplace systems including a secondary heat exchanger for improved fireplace efficiency. More specifically, some embodiments relate to direct vent gas fireplaces having a top ("vertical direct vent") or rear exhaust/inlet duct ("horizontal direct vent") coupled to a secondary heat exchanger, Examples of suitable fireplaces for the system include those sold by Heat-N-Glo Fireplace Products, Inc. of Lakeville, Minn., such as the product identified by Model Number 600DVT. Generally, the fireplace is provided with a primary heat exchanger which accepts primary room air that passes under a combustion chamber of the fireplace, around the back of the combustion chamber, and over the top of the combustion chamber back into the room to provide an efficient convection and radiant heating system.

In some embodiments, the fireplace does not require inside air (i.e., air inside the structure which the fireplace is being used to heat) for combustion, but instead utilizes air passing into the combustion chamber from the exhaust/inlet duct. In some embodiments, the secondary heat exchanger coupled to the exhaust/inlet duct is positioned in a fireplace chase in which a fireplace is installed and driven off a blower housed within the fireplace to draw additional heat off combustion exhaust exiting the fireplace through the exhaust/inlet duct.

Various additional or alternate features and advantages to the foregoing should be apparent with reference to the text and drawings. Although described with reference to direct vent fireplaces, the system optionally includes any of a variety of prefabricated gas fireplaces, such as universal vent, B-vent, horizontal/vertical-vent, dual direct vent, or others.

Figure 1:
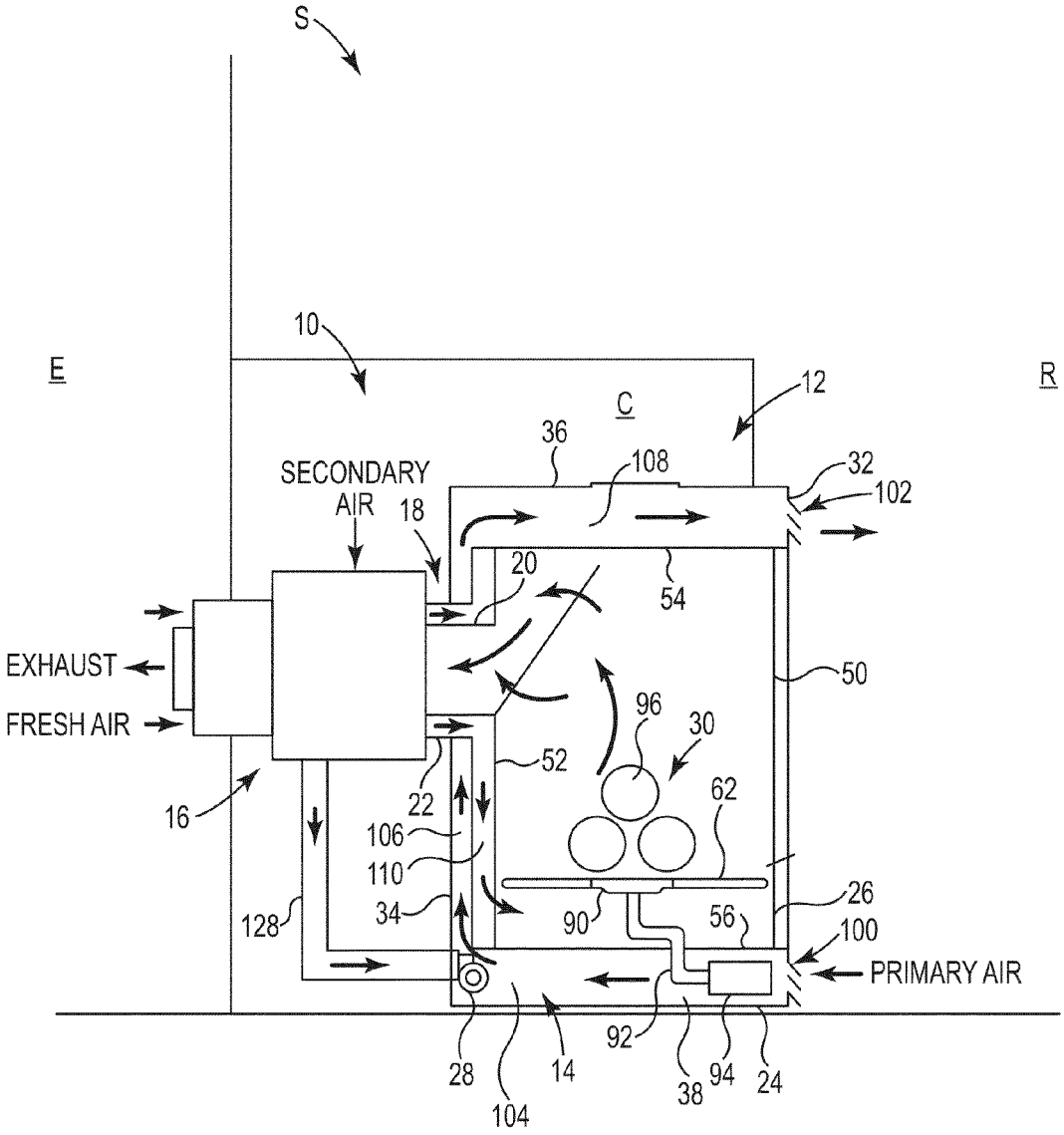
FIG. 1 is a schematic vim of a fireplace system for heating a room in a structure, according to some embodiments.

FIG. 1 is a side, schematic view of a horizontal direct vent configured fireplace system 10 for heating a room R in a structure S, according to some embodiments. The system 10 includes a fireplace 12 with a primary heat exchanger 14 and a secondary heat exchanger 16 connected to the fireplace 12. The fireplace 12 is installed in a framed in chase C, or secondary room, within the structure S and vents exhaust gases to the environment E outside of the structure S. As understood by those of skill in the art, gas fireplaces are often installed in a chase structure that is designed to hold the fireplace with sufficient clearance to be safe and meet local code standards. The fireplace chase is optionally described as a small, secondary room adjacent to the primary room that a fireplace is heating. The fireplace 12 also includes a combined exhaust outlet and combustion air ink: formed by a coaxial duct 18 including an exhaust duct 20 and a fresh air intake duct 22 disposed coaxially about the exhaust duct 20. During operation of the fireplace 12, fresh air entering through the intake duct 22 is preheated by hot exhaust gases passing out of the fireplace through the exhaust duct 20. The fireplace 12 includes a housing 24, a combustion chamber 26, a blower 28, and a combustion assembly 30.

In some embodiments, the housing 24 forms an outer shell of the fireplace 12 and combines with the combustion chamber 26 to define at least a portion of the primary heat exchanger 14, the housing 24 forming an outer wall of the primary heat exchanger 14, according to some embodiments. The housing 24 includes a front 32, a back 34, atop 36, a bottom 38, a first side (not shown) and a second side (not shown).

The combustion chamber 26 includes a front 50, a back 52, a top 54, a bottom 56, a first side 58 (FIG. 2), a second side 60 (FIG. 2), and a support panel 62. Preferably, the front 50 is transparent to allow viewing of components (e.g., a simulated log set) and flames disposed within the combustion chamber 26.

Figure 2:
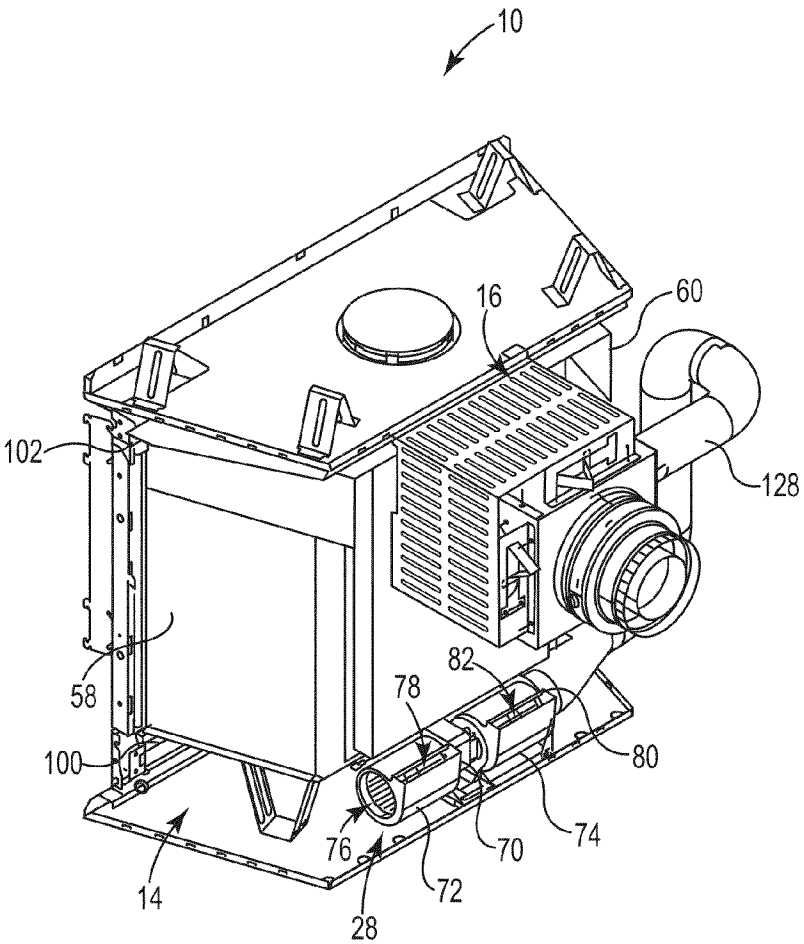
FIG. 2 is an isometric view of the system of FIG. 1, according to some embodiments.

FIG. 2 is an isometric view showing the secondary heat exchanger 16 mounted to the housing, 24, according to some embodiments, with the sides 58, 60 and back 52 of the housing 24 removed for illustration purposes. As shown in FIG. 2, the blower 28 includes a quiet, tow speed motor 70, a first fan assembly 72, and a second fan assembly 74, each of the first and second fan assemblies 72, 74 being connected to the motor 70. The first fan assembly 72 includes an inlet 76 and an outlet 78 and the second fan assembly 74 includes an inlet 80 and an outlet 82. The first fan assembly 72 helps provide a negative pressure for drawing primary room air through the primary heat exchanger 14 and the second fan assembly 74 helps provide a negative pressure for drawing secondary room air through the secondary heat exchanger 16. In some embodiments, the blower 28 is connected to a controller (not shown) and is operated according to a desired blower timing or based upon addition or alternative input, such as a thermistor that allows the controller to activate the blower 28 once a certain temperature is achieved in the combustion chamber 26, primary heat exchanger 14, and/or secondary heat exchanger 16.

As shown in FIG. 1, the combustion assembly 30 includes a burner 90, a gas line 92, a gas valve 94, and a log set 96. The burner 90 is positioned in the combustion chamber 26 (e.g., above or below the support panel 62) to combust gas and thereby generate heat and flames. The burner 90 is coupled by the gas line 92 to a source of combustible gas (not shown). The gas valve 94 is positioned in-line with the gas line 92 and is configured to be opened and closed to regulate or modulate the flow of combustible gas to the burner 90. The log set 96 is optionally positioned above the burner 90, being supported by the support panel 62 and including one on more simulated logs that are formed, for example, of ceramic fibers and a binder.

In some embodiments, the primary heat exchanger 14 defines a primary room air inlet 100 in the front 32 toward the bottom 38 of the housing 24 as well as a primary room air outlet 102 in the front 32 toward the top 36 of the housing 24. The primary heat exchanger 14 includes a. bottom plenum 104, a rear plenum 106, and a top plenum 108 between the housing 24 and the combustion chamber 26. In some embodiments, the blower 28 and/or convective air flow move (primary room air from a room being heated and in which the fireplace 12 is installed into the primary room air inlet 100, through the lower, rear, and top plenums 104, 106, 108, respectively, and out of the primary room air outlet 102 back into the room being heated.

As shown, the combustion chamber 26 is disposed within the housing 24 with the combustion assembly 30 positioned to generate heat and flames in the combustion chamber. The coaxial duct 18 is secured to the housing 24 with the exhaust duct 20 in fluid communication with the combustion chamber 26 to receive combustion byproducts, also described as exhaust air, and the fresh air intake duct 22 configured to deliver intake air from outside the structure in which the fireplace 12 is installed through afresh air plenum 110 to the combustion assembly 30 for generating heat and flames with the burner 90.

Figures 3, 4:
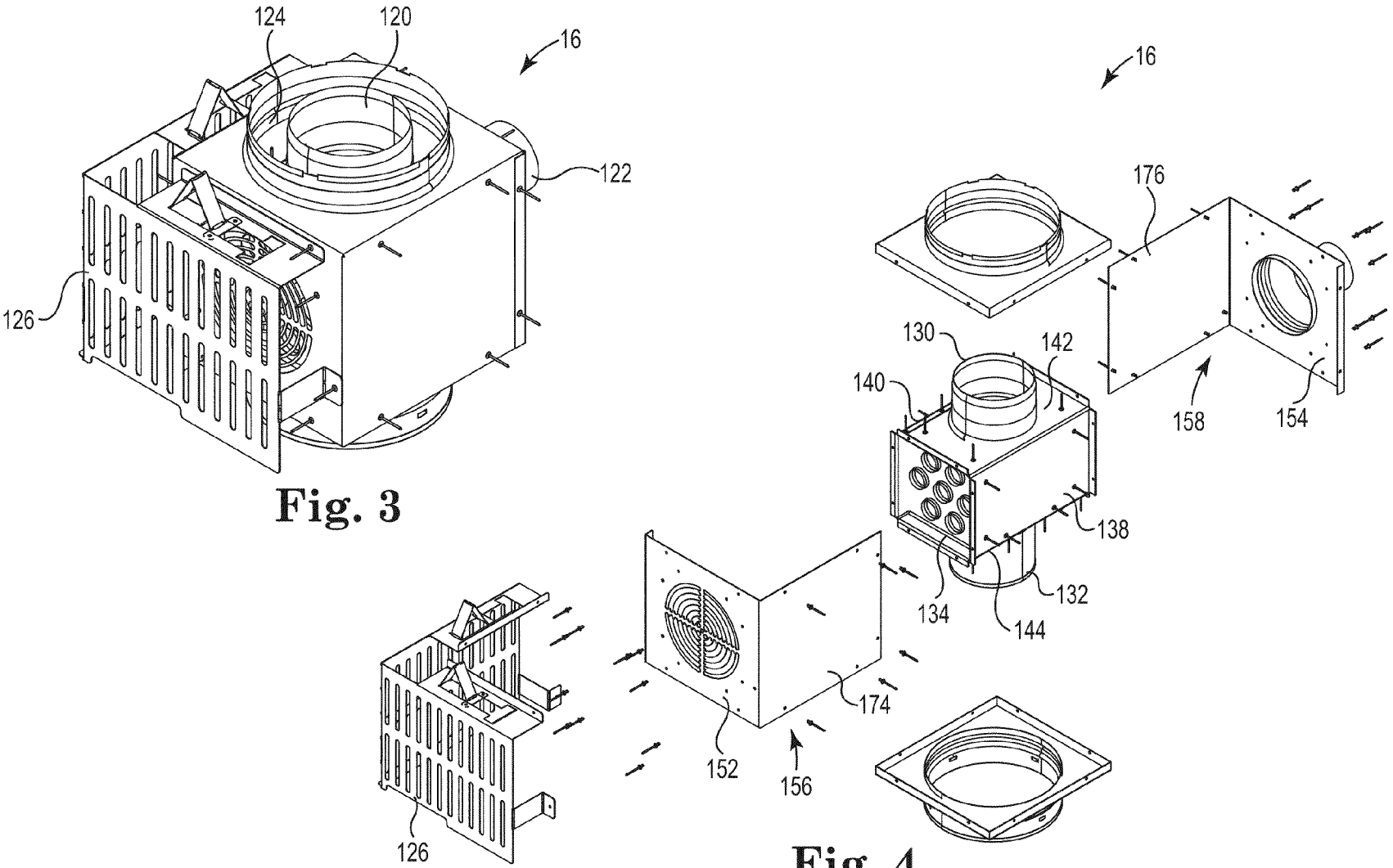
FIG. 3 is an isometric view of a secondary heat exchanger of the system of FIG. 1, according to some embodiments.
FIG. 4 is an isometric view of the secondary heat exchanger of the system of FIG. 1 in an unassembled state, according to some embodiments.
Figure 5:
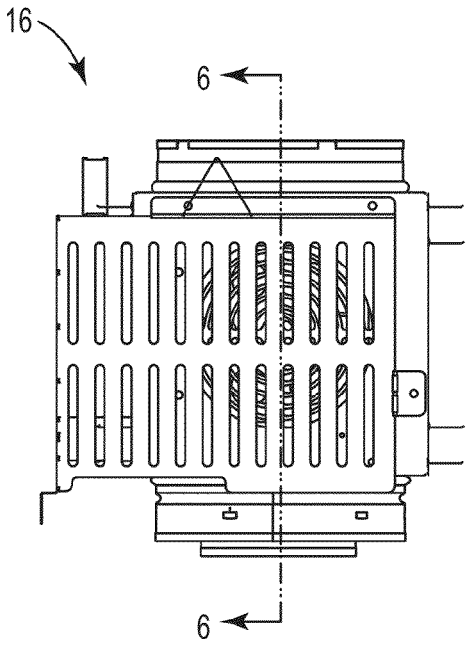
FIG. 5 is a side view of the secondary heat exchanger of FIG. 3
Figure 6:
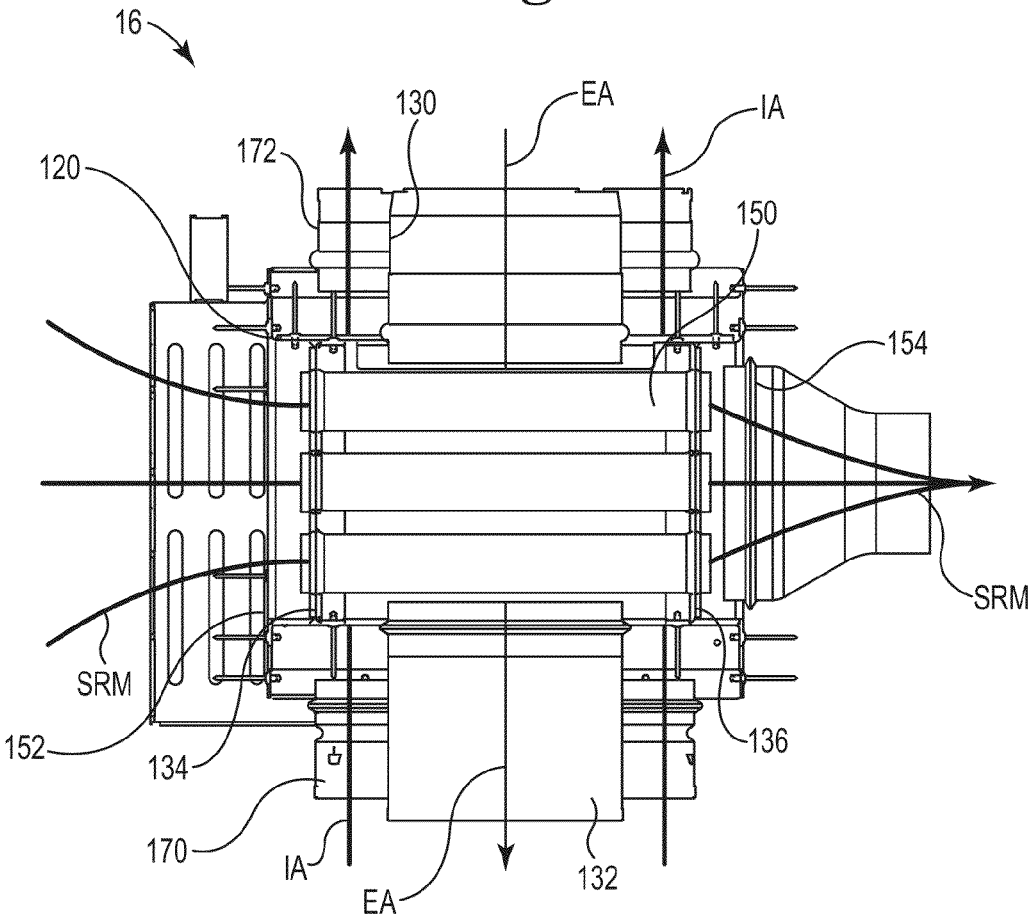
FIG. 6 is a sectional view of the secondary heat exchanger along line 6-6 of FIG. 5, according to some embodiments.

FIG. 3 is an isometric view of the secondary heat exchanger 16 in an assembled state and FIG. 4 is a view of the secondary heat exchanger 16 in a disassembled state. FIG. 5 is a side view of the secondary heat exchanger 16 and FIG. 6 is a sectional view of the secondary heat exchanger 16 along line 6-6 of FIG. 5. As shown, the secondary heat exchanger 16 includes an exhaust air conduit 120, a secondary room air conduit 122, an intake air conduit 124, a guard 126, and one or more coupling ducts 128 (FIG. 2).

In some embodiments, the exhaust air conduit 120 is formed as a substantially rectangular box with an inlet duct 130, an outlet duct 132, first and second end caps 134, 136 (FIG. 6), a first side 138, a second side 140, a top 142, and a bottom 144. As shown, the exhaust air conduit 120 defines an exhaust air plenum that is closed to the environment (e.g., the interior of the structure in which the fireplace 12 is installed) and configured such that exhaust air is able to pass into the inlet duct 130, around the outsides of the secondary room air conduit 122 and the inside of the intake air conduit 124, and out of the outlet duct 132. As shown in FIG. 6, the exhaust air conduit 120 provides an exhaust air pathway EA through the secondary heat exchanger 16, the exhaust air pathway EA entering the inlet duct 130, passing about portions of the secondary room air conduit 122 within the rectangular box, and then passing out of the outlet duct 132.

In some embodiments, the secondary room air conduit 122 includes a plurality of tubes 150 (FIG. 6) maintained by the end caps 134, 136, an inlet cover 152, and an outlet cover 154. As shown in FIG. 4, the inlet and outlet covers 152, 154 are each formed as a part of L-shaped pieces 156, 158 to facilitate assembly of the secondary heat exchanger 16. The inlet cover 152 optionally includes a screen or grate and the outlet cover optionally includes an adapter for connection to ductwork. As shown in FIG. 6, the secondary room air conduit 122 (FIG. 3) provides a secondary room air pathway SRM through the secondary heat exchanger 16, the secondary room air pathway SRM entering through the inlet cover 152, passing through the plurality of tubes 150, and out of the outlet cover 154.

As shown in one or more of FIGS. 3-6, the intake air conduit 124 includes an inlet duct adapter 170, and outlet duct adapter 172, and first and second outer walls 174, 176 that define opposed plenums with the first and second sides 138, 140 of the exhaust air conduit 120. In turn, the inlet and outlet duct adapters 170, 172 define opposed plenums with the top and bottom 142, 144 of the exhaust air conduit 120. As shown in FIG. 6, the intake air conduit 124 (FIG. 3) provides an intake air pathway IA through the secondary heat exchanger 16, the intake air pathway entering through the inlet duct adapter 170, passing around the exhaust air conduit 120 (through the plenums created between the sides 138, 140

(FIG. 4) and top and bottom 142, 144 (FIG. 4) of the exhaust air conduit 120 and the intake air conduit 124), and out the outlet duct adapter 172.

From the foregoing, it should be understood that both the intake air conduit 124 and the secondary room air conduit 122 draw heat off the exhaust air conduit 120, with the intake air pathway IA being generally in counterflow with the exhaust air pathway EA and the secondary room air pathway SRM generally being in crossflow with the exhaust air pathway EA, according to some embodiments. As shown in FIGS. 1 and 2, the secondary heat exchanger 16 is mounted to the fireplace 12 with the coaxial duct 18 of the fireplace 12 connected to an outlet duct adapter 172 (FIG. 6) of the intake air conduit 124 (FIG. 3) and the inlet duct 130 (FIG. 6) of the exhaust air conduit 120 (FIG. 3). The coupling duct 128 is secured to the second fan assembly 74 of the blower 28.

During operation of the system 10, combustible gas is fed to the burner 90 to create heat and flames with hot exhaust air passing out of the combustion chamber 26 through the exhaust duct 20 into the exhaust air conduit 120 of the secondary heat exchanger 16 and out of the structure S. Combustion is fed by fresh intake air from outside the structure S, with the fresh intake air passing into the intake air conduit 124 of the secondary heat exchanger 16 through the intake duct 22, and to the combustion assembly 30. As the exhaust air and fresh intake air pass into the secondary heat exchanger 16, as well as the exhaust and intake ducts 20, 22, is shed from the exhaust air and transferred to the fresh intake air prior to combustion in the combustion chamber 26. The blower 28 of the fireplace 12 operates to help draw primary room air into the primary heat exchanger 14 so that heat from the combustion chamber 26 is transferred to the primary room air before it is released back into the room R. The blower 28 also draws secondary room air from the chase C into the secondary heat exchanger 16, which is preheated by the exhaust air passing through the secondary heat exchanger 16. The secondary room air is injected by the blower into the primary heat exchanger 14 which mixes with the primary room air and is ultimately delivered into the room R being heated.

Figure 7:
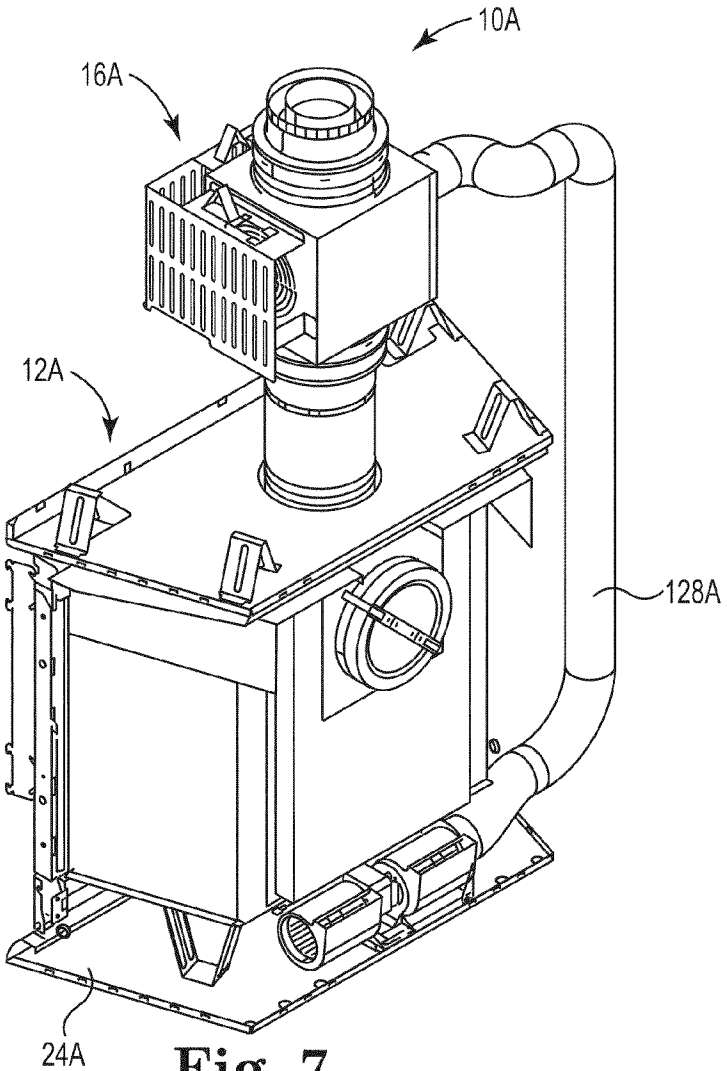
FIG. 7 is an isometric view of another fireplace system for heating a room in a structure, according to some embodiments.

FIG. 7 is an isometric view of a vertical direct vent configured fireplace system 10A including a secondary heat exchanger 16A mounted to a housing 24A of the system 10A, according to some embodiments. As shown in FIG. 7, the rear venting feature is capped, where the sides and back of the housing 24A are removed for illustration purposes. Various features of the systems 10, 10A are substantially similar and, thus, are referenced cumulatively to features of the system 10, where, in the drawing and text, similar features of the system 10A are accorded similar reference numbers to that of the system 10 followed by an "A."

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A fireplace system comprising:

a fireplace including:

a housing having a front, a back, a first side, and a second side;

a combustion chamber disposed within the housing, the combustion chamber and the housing combining to define a primary heat exchanger about the combustion chamber, the primary heat exchanger having an inlet for receiving primary room air from a room in which the fireplace is installed and an outlet for delivering air that has passed through the primary heat exchanger back into the room in which the fireplace is installed;

a combustion assembly including a burner configured for burning combustible gas in the combustion chamber;

an exhaust duct for carrying exhaust air generated by combustion of the combustible gas in the combustion chamber out of the combustion chamber and away from the fireplace; and a fresh air intake duct for carrying fresh air from outside of the fireplace to the combustion assembly; and a secondary heat exchanger including:

an exhaust air conduit for receiving the exhaust air from the exhaust duct of the fireplace;

a secondary room air conduit for receiving secondary room air, the secondary room air conduit receiving the secondary air prior to the secondary air entering any inlet of the primary heat exchanger, the secondary room air conduit generally being in crossflow with the exhaust air;

an intake air conduit for passing fresh intake air into the fresh air intake duct of the fireplace, the secondary heat exchanger being configured to transfer heat from the exhaust air passing through the exhaust air conduit into the secondary room air passing through the secondary room air conduit and the fresh intake air passing through the fresh intake air conduit; and a coupling duct for passing secondary room air from the secondary heat exchanger into the primary heat exchanger.

2. The fireplace system of claim 1, wherein the secondary heat exchanger is mounted to the back of the housing of the fireplace.

3. The fireplace system of claim 1, wherein the fireplace further includes a blower for moving the primary room air through the primary heat exchanger, wherein the coupling duct of the secondary heat exchanger is coupled to the blower.

4. The fireplace system of claim 3, wherein the blower is located in the primary heat exchanger.

5. The fireplace system of claim 3, wherein the blower is located below the combustion chamber of the fireplace.

6. The fireplace system of claim 3, wherein the blower is configured to direct primary room air and secondary room air behind the combustion chamber of the fireplace.

7. The fireplace system of claim 3, wherein the blower includes a motor, a first fan assembly, and a second fan assembly, the first fan assembly being configured to receive primary room air and direct the primary room air through the primary heat exchanger and the second fan assembly being configured to receive secondary room air from the secondary heat exchanger and direct the secondary room air through the primary heat exchanger.

8. The fireplace system of claim 3, wherein the coupling duct extends through the housing of the fireplace to the blower.

9. The fireplace system of claim 1, wherein the secondary heat exchanger is mounted vertically above the fireplace.

10. The fireplace system of claim 1, wherein the secondary heat exchanger is mounted horizontally behind the fireplace.

11. The fireplace system of claim 1, wherein the fresh intake air is in counterflow with the exhaust air conduit of the secondary heat exchanger.

12. A method of heating a room in a structure with a fireplace, the method comprising:

feeding combustible gas to a burner of a combustion assembly of the fireplace to create heat and flames with hot exhaust air passing out of a combustion chamber of the fireplace through an exhaust duct and into an exhaust air conduit of a secondary heat exchanger and out of the structure;

passing fresh intake air from outside the structure into an intake air conduit of the secondary heat exchanger through an intake duct of the fireplace and to the combustion assembly;

passing primary room air from the room in the structure through an inlet into a primary heat exchanger in the fireplace to transfer heat from the combustion chamber to the primary room air; and passing secondary room air through the secondary heat exchanger and from the secondary heat exchanger into the primary heat exchanger, the secondary air passing through a secondary room air conduit of the secondary heat exchanger prior to entering any inlet of the primary heat exchanger, the secondary heat exchanger transferring heat from the exhaust air into the fresh intake air and the secondary room air, the secondary room air conduit generally being in crossflow with the exhaust air.

13. The method of claim 12, wherein passing primary room air from the room in the structure includes a blower of the fireplace operating to help draw primary room air into the primary heat exchanger so that heat from the combustion chamber is transferred to the primary room air before it is released back into the room.

14. The method of claim 13, wherein the blower also draws secondary room air into the secondary heat exchanger, which is preheated by the exhaust air passing through the secondary heat exchanger, the secondary room air being injected by the blower into the primary heat exchanger and mixing with the primary room air to be delivered into the room being heated.

15. The method of claim 14, wherein the blower includes a motor, a first fan assembly, and a second fan assembly, the first fan assembly to receiving the primary room air and directing the primary room air through the primary heat exchanger and the second fan assembly receiving secondary room air from the secondary heat exchanger and directing the secondary room air through the primary heat exchanger.

16. The method of claim 12, wherein the fireplace is installed in a fireplace chase and the secondary room air is drawn from the fireplace chase.

17. The method of claim 12, wherein the fresh intake air is in counterflow with the exhaust air conduit of the secondary heat exchanger.

18. A fireplace system comprising:

a fireplace including:

a housing having a front, a back, a first side, and a second side;

a combustion chamber disposed within the housing, the combustion chamber and the housing combining to define a primary heat exchanger about the combustion chamber, the primary heat exchanger having an inlet for receiving primary room air from a room in which the fireplace is installed and an outlet for delivering air that has passed through the primary heat exchanger back into the room in which the fireplace is installed;

a combustion assembly including a burner configured for burning combustible gas in the combustion chamber;

an exhaust duct for carrying exhaust air generated by combustion of the combustible gas in the combustion chamber out of the combustion chamber and away from the fireplace; and a fresh air intake duct for carrying fresh air from outside of the fireplace to the combustion assembly;

a secondary heat exchanger including:

an exhaust air conduit for receiving the exhaust air from the exhaust duct of the fireplace;

a secondary room air conduit for receiving secondary room air;

an intake air conduit for passing fresh intake air into the fresh air intake duct of the fireplace, the secondary heat exchanger being configured to transfer heat from the exhaust air passing through the exhaust air conduit into the secondary room air passing through the secondary room air conduit and the fresh intake air passing through the fresh intake air conduit; and a coupling duct for passing secondary room air from the secondary heat exchanger into the primary heat exchanger; and a blower for moving the primary room air through the primary heat exchanger, the coupling duct of the secondary heat exchanger being coupled to the blower, and the blower including:

a motor, a first fan assembly, and a second fan assembly, the first fan assembly being configured to receive primary room air and direct the primary room air through the primary heat exchanger and the second fan assembly being configured to receive secondary room air from the secondary heat exchanger and direct the secondary room air through the primary heat exchanger.

19. The fireplace system of claim 18, wherein the secondary room air conduit is in crossflow with the exhaust air.

20. The fireplace system of claim 18, wherein the fresh intake air is in counterflow with the exhaust air conduit of the secondary heat exchanger.

* * * * *